US006845729B2

(12) United States Patent
Godek

(10) Patent No.: US 6,845,729 B2
(45) Date of Patent: Jan. 25, 2005

(54) PADDLE BOAT WATER REMOVAL SYSTEM AND METHOD OF USE

(76) Inventor: Joseph Godek, 17 Ledge Rd., Pelham, NH (US) 03076

( * ) Notice: Subject to any disclaimer, the term of this patent is extended or adjusted under 35 U.S.C. 154(b) by 0 days.

(21) Appl. No.: 10/403,248

(22) Filed: Mar. 31, 2003

(65) Prior Publication Data

US 2004/0187761 A1 Sep. 30, 2004

(51) Int. Cl.[7] ..... B63B 35/00
(52) U.S. Cl. ..... 114/347
(58) Field of Search ..... 114/39.23, 39.17, 114/347, 68, 123, 69, 360

(56) References Cited

U.S. PATENT DOCUMENTS 5,279,248 A 1/1994 Blachford
5,411,425 A * 5/1995 Rinker ..... 441/130
5,429,062 A 7/1995 Trabka
5,542,369 A 8/1996 Ingram
6,129,600 A * 10/2000 Nordby ..... 440/101
6,343,562 B1 2/2002 Ingram
2003/0032507 A1 * 2/2003 Lacroix et al. ..... 473/593

* cited by examiner

*Primary Examiner*—Stephen Avila
(74) *Attorney, Agent, or Firm*—Robert R. Deleault, Esq.; Mesmer & Deleault, PLLC

(57) ABSTRACT

A kayak and canoe refloating device includes a flotation mat and at least two tethers configured for flexible attachment on one end to the flotation mat and on the other end to the side of the kayak and canoe. The flotation mat has a plurality of baffles and a length, width and depth when inflated sufficient to support a major portion of a water-filled kayak or a canoe when rolled into an upside down position onto the flotation mat for draining the kayak or canoe.

12 Claims, 3 Drawing Sheets

PADDLE BOAT WATER REMOVAL SYSTEM AND METHOD OF USE

BACKGROUND OF THE INVENTION

1. Field of the Invention

The present invention relates generally to boating. Particularly, the present invention relates to personal boats. More particularly, the present invention relates to personal paddle boat water drainage devices.

2. Description of the Prior Art

One and two person paddle boats are typically known in the art as, and for purposes of the present invention are defined as, canoes, kayaks and the like. Canoes have generally been made of wood, paper, metal, fiberglass, or other man-made composites. Kayaks have generally been made of flexible materials, foldable materials, inflatable materials, plastic, fiberglass, or other manmade composites. Solo kayaks and canoes seat one person. Tandem kayaks and canoes seat two persons.

Canoes and kayaks come in many lengths and widths and hull shapes defined for needs specific to differing uses. Canoes generally have sides that rise separately upward from a lowest point in the water to form the hull as an inner cavity that floats. A seat is usually located within this hull. A boater can sit on the seat in an upright position with knees bent as if sitting on a chair, be it a very small chair. A canoe may have portions with upper coverings, called decks, at its front (the bow), or at its rear (the stern), or at both locations.

Kayaks, in contrast to canoes, have a shallow hull that displaces less water and has a lower profile than the hull of a canoe. The inner cavity of a kayak usually has a full deck that aids in keeping water out, especially since the lower profile is more likely to be swamped in rough water. An oval or round cockpit hole in the deck of the kayak allows the kayaker to enter the kayak and sit down. A kayaker usually sits on a seat positioned on the bottom of the kayak with the kayaker's legs extended out in front and the kayaker's feet resting on foot rests.

When a solo or tandem paddle boater paddles in turbulent water, the waves can simultaneously be thrilling and dangerous. Rougher waves can come over the sides of the boat and completely overturn the boat all at once. When a paddle boat has completely turned over and the boater or boaters have been ejected, these boaters preferably choose to drag their boat to shore if the shore is close enough as this is easier to do than trying to drain the paddle boat and re-enter the drained paddle boat from the water. But, if the body of water is large and enclosed, such as a lake, or if the boater or boaters are boating along the seacoast, reaching the shoreline may not be feasible.

Kayaks are particularly dangerous in rough water as they are more likely to overturn. When a solo kayaker has been overturned, he may be able to perform a maneuver with just his body and his paddle known as a roll. In a roll, the kayaker stays in the cockpit while underwater and, by generating torque about the long axis of the kayak, forces the kayak upright by using his paddles and his body.

U.S. Pat. No. 5,279,248 (Blachford, 1994) discloses a solo kayak righting apparatus and method for reducing the skill required of a paddler to right a capsized kayak without exiting it. In broad terms, the paddler is provided with a simple and rapid means of creating a buoyant force to one side of the capsized kayak, which can be used to produce an amount of torque for righting the kayak. The apparatus is an inflatable flotation device that is held in place on the deck of the kayak and is provided with a handle. Upon capsizing, the paddler grasps and pulls the handle, whereupon the flotation element is released from its securing container and automatically inflated from compressed gas cartridges. The paddler can then lean on the handle and attached flotation element to right the kayak without exiting it.

The roll maneuver is unreliable because it is not often practiced in capsizing conditions or under differing packed kayak loads or using different paddles. If the solo kayaker fails at a roll, he or she must exit the kayak while underwater, drain the kayak while in the water, and then re-enter the kayak from the water. Draining the kayak of water while the kayaker is in the water is an extremely difficult if not impossible task regardless of the experience of the kayaker.

Roll maneuvers are not possible in a tandem kayak or in any type of canoe. The tandem kayak is too long and requires too much torque and common coordination between two kayakers for a roll maneuver to be successful. Canoes do not have an encapsulated compartment for roll maneuvers to be possible. If a tandem kayak or any canoe is overturned, these boaters need to drain the paddle boat of water, and then re-enter the paddle boat from the water. Devices have been developed to bail a filled watercraft as well as to help a kayaker get out of the water.

U.S. Pat. No. 5,429,062 (Trabka, 1995) discloses a rapid bailing device. The bailing device is used with a watercraft having a hull adapted to sit in a body of water and having a deck normally above a waterline defined by the body of water and formed centrally with a cockpit. The bailing device has a pair of inflatable flexible enclosures of a volume sufficient to support the watercraft out of the water when the enclosures are inflated. The enclosures are attached to the deck above the waterline to either side of the cockpit and a tube interconnects the enclosures so that air can pass through the tube between them. The enclosures can be inflated with air while they are attached to the deck. When thus inflated with the craft in the water, the watercraft can be inverted and supported on the inflated enclosures to drain water from the cockpit.

U.S. Pat. No. 5,542,369 (Ingram, 1996) discloses a kayak safety buoyancy stirrup. The kayak safety buoyancy stirrup consists of an adjustable stirrup and an inflatable buoyancy bag flexibly attached to the deck of a kayak. The buoyancy stirrup is carried on the deck of the kayak and permits immediate deployment by a kayaker in the water, on either side of the kayak. The buoyancy stirrup has sufficient buoyancy to allow a disabled kayaker to step out of the water immediately to prevent hypothermia and lie across the device and the kayak deck in extreme emergencies. With a foot in the stirrup and hands and arms entwined in kayak deck rigging, the device helps prevent the kayaker from falling into cold water again. The inflatable buoyancy bag has an air-tight closure mechanism to permit stowage of bulky, lightweight items. Pouches containing safety equipment such as kayak safety sponsons may be attached to the bag to organize and prevent forgetting of vital safety equipment.

U.S. Pat. No. 6,343,562 B1 (Ingram, 2002) discloses canoe and kayak mid-point sponsons that act as safety ballasts by stabilizing the flooded canoe or kayak until it can get to shore or to a rescue boat. The canoe and kayak mid-point sponsons attach to the canoe or kayak only at the mid-point of the sponsons, to enable the sponsons to rotate around the midpoints in order to reduce drag in waves and simplify attachment and detachment to the canoe or kayak. The mid-point sponsons permit much greater buoyancy volume than any other type of sponson, without interfering with normal paddling to safety. They are attached to any canoe or kayak by material such as only one adjustable strap and two clips, extending to kayak deck fittings adjacent the cockpit or a canoe middle thwart, in such a manner as to facilitate normal padding of the stabilized craft in life threatening emergencies. The mid-point sponsons can be solid buoyant material, waterproof and airtight stowage bags containing bulky lightweight items such as sleeping bags, orally inflatable sponson floats, and gas cartridge inflatable sponson floats. A particular feature is permanent or semi-permanent attachment to the hull above the waterline to eliminate drag unless inflated, in which case the inflated sponsons are forced to immerse in the water. When not inflated each midpoint sponson would be neatly stowed in a small and rescue-emergency marked stowage bag or covering that holds sponsons upward from the waterline. Such an arrangement ensures that the sponsons rest sleekly and unobtrusively along the hull side when not deployed.

Each of the prior art devices has disadvantages or drawbacks. The Trabka bailing device assists with rapid boat drainage by a boater or boaters in the water but does not assist those boaters in the water with re-entering the boat after draining. The Ingram safety buoyancy stirrup assists the boater in crisis to get partially out of the water but does not assist the boater in draining water from his boat or to fully re-enter his boat. The Ingram mid-point safety sponsons assist the boater in getting back into the boat from the water and then in keeping the water-filled boat stable and afloat until the boater can get to shore but does not allow for easy drainage of the boat.

Therefore, what is needed is a water removal system that assists capsized boaters in the water with draining their waterlogged paddle boat while keeping the boat afloat. What is also needed is a water removal system that assists capsized boaters in re-entering the boat from the water.

SUMMARY OF THE INVENTION

It is an object of the present invention to provide a water removal system that can be used by a boater or boaters who are in the water outside of their capsized boat. It is another object of the present invention to provide a water removal system that is attached to the paddle boat and prevented from loss when the boat initially turns over. It is a further object of the present invention to provide a water removal system that assists capsized boaters in the water with draining their water-filled paddle boat while also keeping the boat afloat. It is still another object of the present invention to provide a water removal system that assists capsized boaters in re-entering the boat from the water. It is yet another object of the present invention to provide a water removal system that also floats and elevates the user to the same level as the paddle boat so the boater or boaters can more easily climb from the water back into the paddle boat once the water has been removed.

The present invention achieves these and other objectives by providing a paddle boat water removal system that combines a paddle boat with a selectively attachable waterproof flotation mat that is relatively compact for storage while remaining secured to the boat to prevent loss in the water. The paddle boat must be dimensioned to allow a boater or boaters in the water to be capable of rolling the boat along its central, longitudinal axis approximately 180 degrees onto the water removal device.

The paddle boat water removal system is an inflatable flotation mat large enough to support a one or two-person paddle boat. The flotation mat is configured with a plurality of internal baffles capable of holding air such that, when inflated, takes on the shape of an inflatable mattress. It is an important and critical feature of the water removal system that the flotation mat lay in a relatively horizontal and flat configuration over a major portion of the floatation mat's volume as it floats on the surface of a body of water.

The baffles that hold air within the inner surface of the mat can be of any shape as long as the chosen shape allows the mat to lie relatively horizontal and flat over a major portion of the mat's volume as it floats on the surface of a body of water. Bulges in the mat interfere with the ability of the mat to float in a relatively flat horizontal position and impedes the rolling action of the paddle boat onto the mat.

The flotation mat is made of any waterproof material. The material may contain multiple layers where the inner layer that forms the baffle surface is waterproof and the outer layer has a non-slippery characteristic. An example of a non-slip layer is canvas. The flotation mat has a plurality of enforced rope loops or other fasteners for flexibly attaching the mat alongside the paddle boat.

The stored mat must be flexibly and removably secured to the boat in at least one location to prevent the mat from floating away before or during use of the system. The stored mat must be removably affixed in a manner that does not allow the mat to accidentally disengage from the boat and float away before use. The mat should have several additional mat attachment components capable of flexibly and removably securing the mat to the boat before or after the mat is inflated for water removal usage.

The paddle boat of the water removal system can be any type of kayak, canoe, or other personal or dual user boat. The highest requirement for the paddle boat is that the boat be dimensioned such that the user or users are able to roll the boat along its central, longitudinal axis and back again. The paddle boat preferably has a mat storage location where the mat is stored in a collapsed state when not in use. The paddle boat will have one or more storage attachment locations where the mat is capable of being attached when in its collapsed storage state. The paddle boat should also have additional boat attachment components that allow the mat to be flexibly attached to the paddle boat before or after the mat is inflated. These boat attachment components are in addition to the mat storage attachment locations. Typically, the attachment components are rings, hooks or other components affixed along the sides of the paddle boat, or they mat be the decking cord, depending on the configuration of the flexible tethers attached to the flotation mat. These mat attachment components, or flexible tethers, are configured to receive the boat attachment components that are correspondingly affixed to the mat.

Should a user have water come into the user space within the paddle boat, the user disengages the mat from its storage location and secures it along the length of one side of the boat. Once the mat is secured, the mat is then inflated. Although the flotation mat may be inflated before securing it along its length to the paddle boat, securing the mat before inflation makes the securing process easier to perform. The flotation mat may be configured to be capable of 1) automatic self-inflation, 2) having air manually blown in by a user, or 3) a combination of automatic, partial self-inflation and manual inflation. Even where the mat is of the automatic self-inflation type, it is preferable that the mat also be capable of manual inflation. Manual inflation may be accomplished by operating a manual air pump or with air supplied from the user's mouth.

Once the flotation mat is inflated, the user positions himself or herself so that the swamped paddle boat can be rolled onto the inflated flotation mat such that the water drains out of the paddle boat while the flotation mat supports the paddle boat. The boat can be grasped at one end and turned along its length or grasped across its width and turned. As the boat is rolled, the flotation mat will partially submerge under the weight of the water-filled vessel. The buoyancy of the flotation mat causes water to quickly drain from and rapidly raises the overturned boat above the water.

When the water has drained, the user rights the boat and climbs onto the flotation mat to get back into the user space within the boat. The flotation mat simultaneously stabilizes the boat by keeping it from overturning while the user climbs into the boat and also elevates the user above the surface of the water, which makes it easier for the user to re-enter the boat. Once the user is back in the boat, he or she releases the detachable portions of the flotation mat, deflates the mat, rolls, folds, or crunches up the mat and places it back into the storage space on the paddle boat. The mat is kept stored unless needed for re-use. It is also noted that the mat may be dragged behind the boat instead of deflating it. Once the user arrives at a shore, the mat can be removed, cleaned and dried to maintain pliability of the waterproof material.

DETAILED DESCRIPTION OF THE PREFERRED EMBODIMENT

Figure 1:
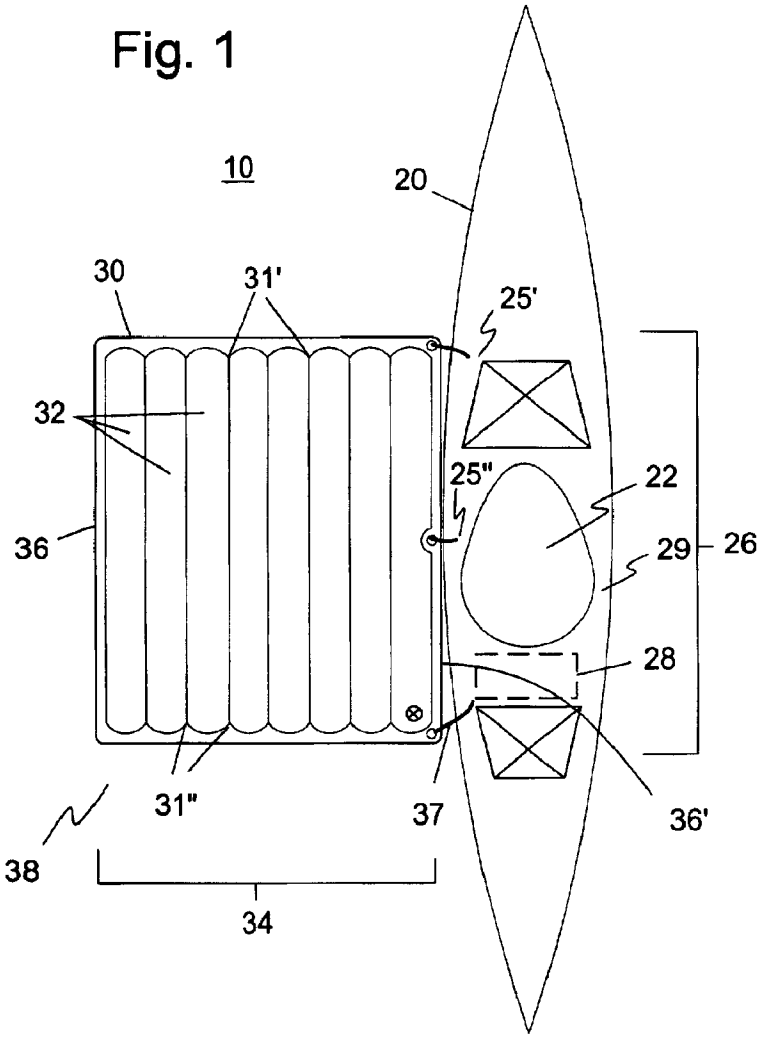
FIG. 1 is a top plan view of the present invention showing the paddle boat water removal system connected to a kayak.

The preferred embodiment of the present invention is illustrated in FIGS. 1–5. FIG. 1 is a top plan view of a paddle boat water removal system 10 showing a paddle boat 20 and a flotation mat 30. Paddle boat 20 is shown as a one-person kayak having a user space 22, which is commonly referred to as a cockpit. Storage location 28 for flotation mat 30 is preferably located behind user space 22, but may be stored in other locations such as, for example, in front of the cockpit or along the side of paddle boat 20. When flotation mat 30 is in a stored configuration, flotation mat 30 is flexibly and removably attached by at least one mat securing tether 37 to paddle boat 20. Mat securing tether 37 is configured to sufficiently secure flotation mat 30 to paddle boat 20 so that mat securing tether 37 cannot be accidentally disengaged and become separated from paddle boat 20 in the event of a capsize or because of rough water.

During use, flotation mat 30 is attached lengthwise along one side of paddle boat 20 in deployment location 38 at two or more points of attachment such as at boat locations 25' and 25" using flexible straps, cord and the like. Flotation mat 30 may be located along and connected to either side of paddle boat 20, according to the preference of the user. Deployment location 38 is preferably centered along a length 26 of paddle boat 20 adjacent user space 22. It is preferable that flotation mat 30 is positioned along side of paddle boat 20 such that user space 22 is at about the midpoint of side 31 of flotation mat 30.

Flotation mat 30 is made up of a plurality of cylindrical baffles 32 where each of the plurality of cylindrical baffles 32 defines an inner volume for containing air. The number and size of the baffles used to make up the plurality of baffles 32 defines the width 34 of flotation mat 30. Each one of the plurality of baffles 32 communicates with one another typically near the ends 31', 31" of length 36 to equally intersperse a total volume of air within flotation mat 30. Equal communication among the plurality of baffles 32 allows flotation mat 30 to float atop the surface of a body of water. When inflated, flotation mat 30 has a length, width and depth sufficient to support a major portion of a water filled kayak or canoe when rolled into an upside down position onto flotation mat 30 for draining the kayak or canoe.

In the embodiment of paddle boat 20 shown in FIG. 1, which is a single-person kayak, user space 22 is a relatively small opening just big enough for a user to climb into paddle boat 20 and sit down low to the water with his or her legs extended forward. As previously explained, a storage location 28 behind user space 22 may be used to store flotation mat 30. Flotation mat 30 may also be stored in other locations such as along a side 29 of user space 22. In this configuration, flotation mat 30 need only be laid open, for example by unrolling, from side 29 and inflated for use.

Figure 2:
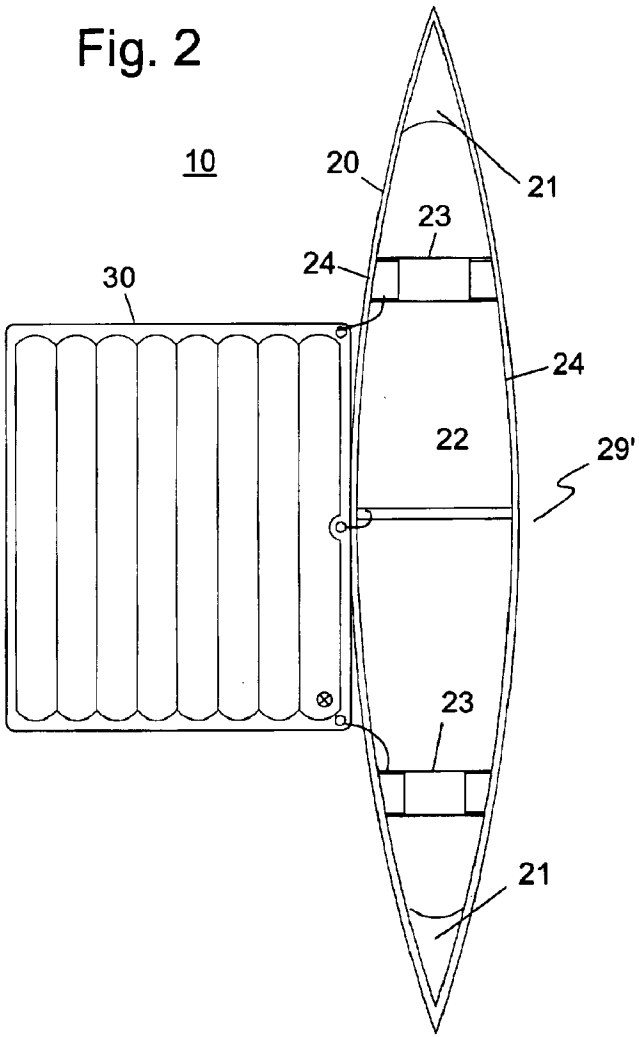
FIG. 2 is a top plan view of the present invention showing the paddle boat water removal system connected to a canoe.

In a canoe embodiment of paddle boat 20 illustrated in FIG. 2, a user has a much larger user space 22 where either a single user can sit on a seat 23 that is typically near the top of the gunwales 24 with legs typically bent at the knee. Flotation mat 30 may be stored in user space 22 under seat 23 or in one of the ends 25 of the hull of the canoe. Storage location 28 may also be along the side of the canoe.

It is understood by those skilled in the art that in a two-person paddle boat, flotation mat 30 must be correspondingly sized for use with the larger size of the paddle boat. The size of flotation mat 30 for use with a two-person paddle boat must be sufficient to be able to support the paddle boat sufficiently above the water surface to allow the water to drain out of the paddle boat during the emptying process, which is explained below. As an example, an inflated flotation mat 30 having a length of approximately 6 feet is sufficient to support a one-person kayak during the draining process.

Figure 3:
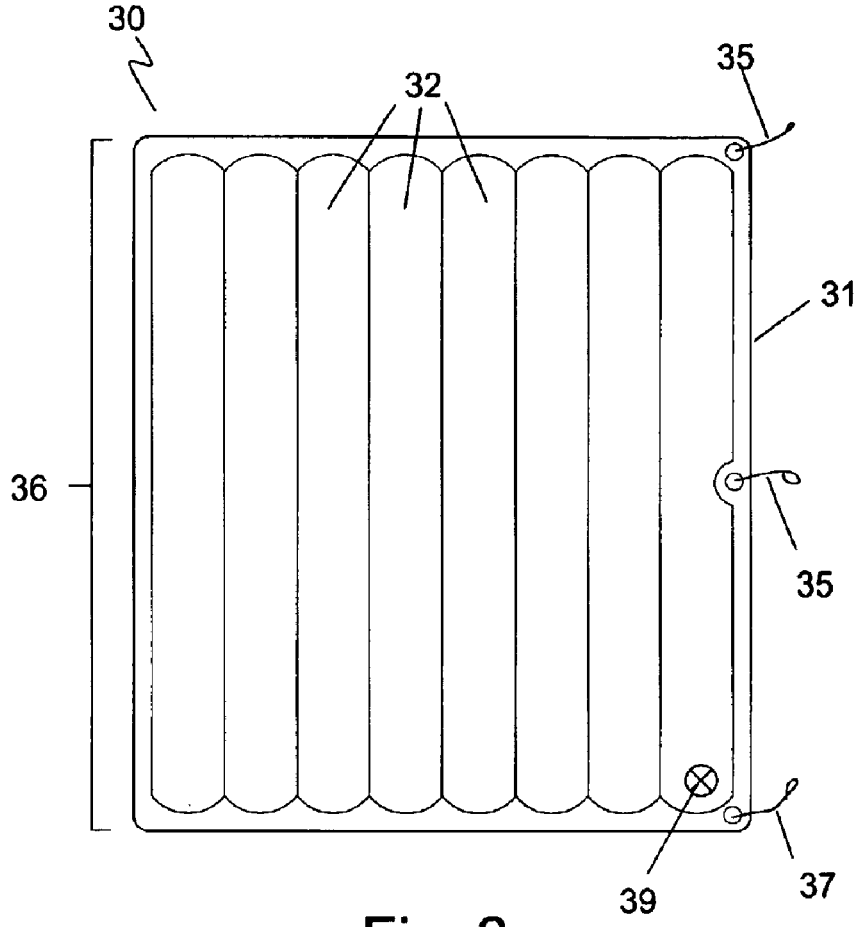
FIG. 3 is a top plan of the present invention showing the flotation mat.

FIG. 3 is a top plan view of flotation mat 30. Flotation mat 30 preferably has mat securing tether 37 adjacent the end of length 36 of side 31 that engages with a boat attachment location 27 (not shown) of paddle boat 20. Flotation mat 30 also has a plurality of mat securement components 35 dispensed along length 36 of side 31. Mat securement components 35 are used to removably secure flotation mat 30 to the side of paddle boat 20 during use. Mat securement components 35 may be any structure that allows flotation mat 30 to be removably connected to paddle boat 20 such as, for example, grommets with tethered clips for connecting to corresponding rope rings or decking cord on paddle boat 20. Flotation mat 30 has at least one valve 39 correspondingly near mat securing tether 37 that allows the introduction of air into the plurality of baffles 32.

An oral inflation tube 40 (not shown) may be attached to valve 39 to introduce air into the inner compartments of the plurality of baffles 32 that compose flotation mat 30. Oral inflation tube 40 may be a separate component or may be permanently attached to valve 39. A manual air pump may also be used to introduce air into flotation mat 30 where the pump is configured to sealingly connect to valve 39. In addition to or instead of a manual air pump or an oral inflation tube, pre-charged compressed-gas cartridges may also be sealingly attached to valve 39 (or they may be separate and disctinct components capable of sealing engagement with valve 39), or they may be configured to valve 39 in such a way that simply pulling a rip cord releases the compressed gas into flotation mat 30, much like those available on some conventional models of personal flotation devices. It should be noted that flotation mat 30 may include additional valves and may have compartmentalized baffles where a leak in one baffle would not compromise the air in the baffles of a different compartment.

Figure 4:
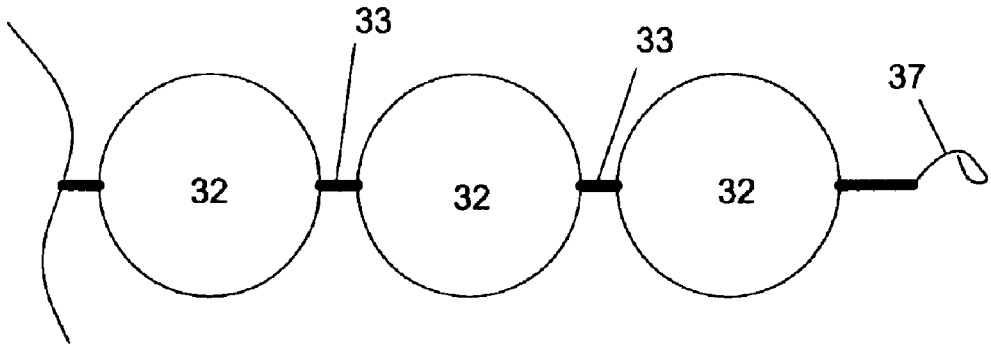
FIG. 4 is an enlarged, partial, cross-sectional view of the flotation mat of the present invention showing an attachment component.

FIG. 4 is a partial cross-sectional view of flotation mat 30. The distance between each of the plurality of baffles 32 has been exaggerated for clarity. Plurality of baffles 32 is interconnected lengthwise along seams 33 in the material used to make flotation mat 30. Seams 33 provide flexibility to flotation mat 30. The flexibility of seams 33 allow flotation mat 30 to float atop the water surface and move with the water surface while maintaining a relatively constant average thickness throughout a major portion of flotation mat 30. This configuration more readily and easily allows the rolling technique of the system to be performed.

Figure 5A:
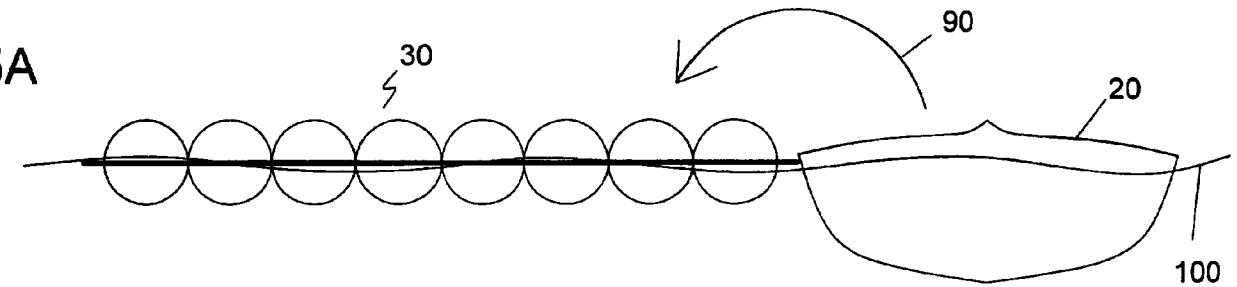
FIG. 5A is an end view of a deployed and inflated flotation mat attached to a paddle boat that is filled with water.
Figure 5B:
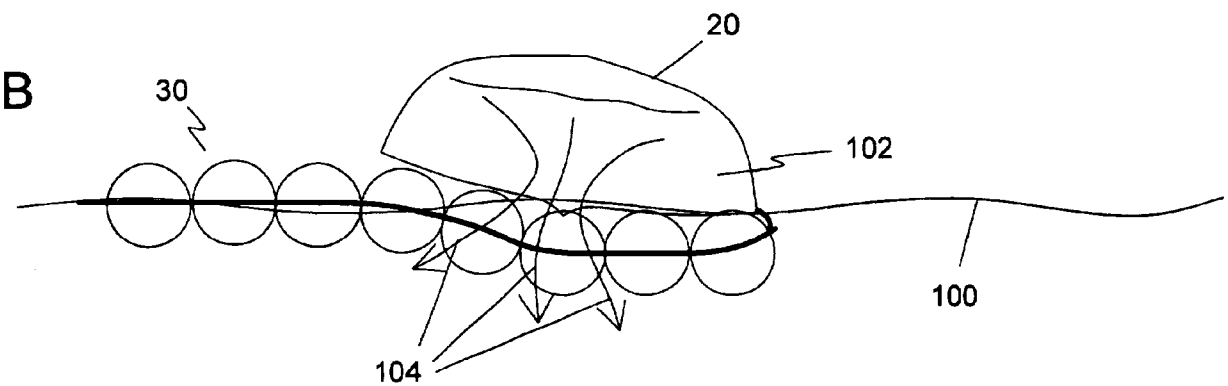
FIG. 5B is an end view of the embodiment shown in FIG. 5A in a paddle boat draining position.
Figure 5C:
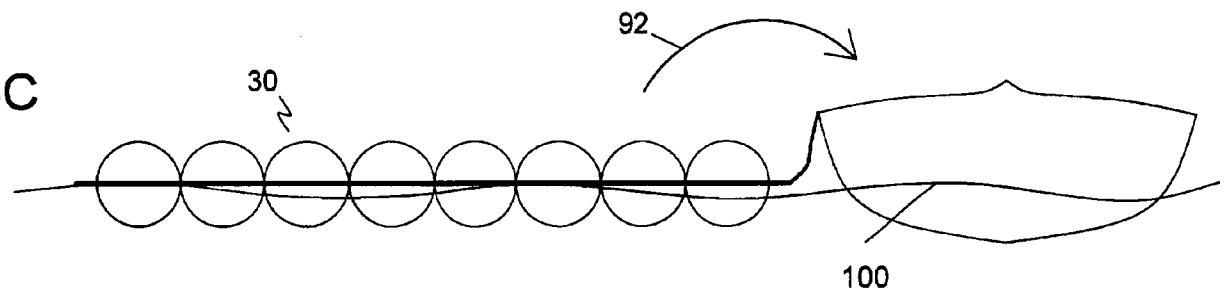
FIG. 5C is an end view of the embodiment shown in FIG. 5B afloat after draining the paddle boat.

Turning now to FIGS. 5A, 5B, and 5C, there is illustrated an end view of paddle boat 20 with flotation mat 30 inflated and flexibly connected to the side of paddle boat 20. Reference number 100 represents the surface of the water. FIG. 5A shows a swamped paddle boat 20 filled with water before emptying. Arrow 90 indicates the direction in which the user would roll paddle boat 20 onto flotation mat 30. Flexible tethers 37 are of a length sufficient to permit the rolling maneuver to occur. FIG. 5B shows the position of paddle boat 20 in a full-rolled position onto flotation mat 30. Flotation mat 30 supports paddle boat 20 sufficiently above water level 100 to allow the water 102 within paddle boat 20 to drain out as illustrated by arrows 104. As paddle boat 20 drains, the water spills onto flotation mat 30 and back into the body of water. Once paddle boat 20 is substantially empty of all water, paddle boat 20 is returned to its upright, floating position. This is accomplished by rolling back paddle boat 20, as shown by arrow 92, from the draining position shown in FIG. 5B to an upright, floating position. A user can now climb out of the water and onto flotation mat 30 and enter paddle boat 20 relatively easily without fear of swamping paddle boat 20 as would likely happen if flotation mat 20 were not available. But for flotation mat 30, it is unlikely that (1) a user would be able to empty paddle boat 20 from the water, and then (2) enter paddle boat 20 without causing paddle boat 20 to swamp/fill up with water again.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

What is claimed is:

1. A method of emptying a water-filled paddle boat while in the water, said method comprising:

positioning a flotation mat along a side of said paddle boat;

flexibly attaching a side of said flotation mat to said side of said paddle boat; and rolling said paddle boat toward an upside-down configuration onto said flotation mat to drain said paddle boat.

2. The method or claim 1 further comprising inflating said flotation mat.

3. A method of claim 1 further comprising reverse rolling said paddle boat to an upright floating position once a substantial portion of the water within said paddle boat is drained.

4. The method of claim 3 further comprising getting into said floating paddle boat.

5. The method of claim 4 further comprising climbing onto said flotation mat after reverse rolling said paddle boat in order to facilitate getting into said paddle boat.

6. The method of claim 3 wherein said deploying step further includes inflating said flotation mat.

7. A kit for draining a swamped paddle bout and facilitating re-entry into said substantially empty paddle boat, said kit comprising:

an inflatable mat having a plurality of baffles;

at least two tethers adapted far attaching a first tether end of each of said at least two tethers to said inflatable mat and a second tether end of each of said at least two tethers to a side of said paddle boat; and instructions for attaching said inflatable mat to said side of said paddle boat and for describing a rolling technique wherein said paddle boat is rolled toward said side attached to said inflatable mat and onto said inflatable mat to drain said paddle boat.

8. The kit of claim 7 further comprising a container for storing said inflatable mat said at least two tethers and said instructions.

9. The kit of claim 7 further comprising an air pump.

10. The kit of claim 7 wherein said inflatable mat has at least one air valve.

11. The kit of claim 10 wherein said plurality of baffles further includes one or more independent air compartments.

12. The kit of claim 7 wherein said instructions further include describing a re-entry technique for entering said substantially empty paddle boat by using said inflatable mat as a platform for supporting a user to ease the entry of said user into said substantially empty paddle boat.

* * * * *